US011459746B1

(12) United States Patent
Fiorilla et al.

(10) Patent No.: US 11,459,746 B1
(45) Date of Patent: Oct. 4, 2022

(54) FOAM-BASED SEAL FOR ANGULAR EXPANSION JOINT SEGMENTS

(71) Applicant: Schul International Co., LLC, Hudson, NH (US)

(72) Inventors: Nicholas A. Fiorilla, Hudson, NH (US); Michael M. Sebold, Cleveland Heights, OH (US)

(73) Assignee: Schul International Co., LLC, Hudson, NH (US)

( * ) Notice: Subject to any disclaimer, the term of this patent is extended or adjusted under 35 U.S.C. 154(b) by 135 days.

(21) Appl. No.: 17/165,103

(22) Filed: Feb. 2, 2021

(51) Int. Cl.
*E04B 1/68* (2006.01)
*E04B 1/00* (2006.01)

(52) U.S. Cl.
CPC ..... *E04B 1/6812* (2013.01)

(58) Field of Classification Search
CPC ..... E04B 1/6812; E06B 2001/626
USPC ..... 52/741.4, 396.05; 404/69
See application file for complete search history.

(56) References Cited

U.S. PATENT DOCUMENTS 3,375,763 A * 4/1968 Welch ..... E01C 11/126 14/73.1
3,829,229 A * 8/1974 Britton ..... E01C 11/126 404/69
4,022,538 A * 5/1977 Watson ..... E01C 11/126 404/69
4,131,382 A * 12/1978 Hymo ..... E01D 19/06 404/69
4,614,067 A * 9/1986 Matsubara ..... E06B 1/64 52/235
5,028,168 A * 7/1991 Conversy ..... E01C 11/126 404/69
5,377,469 A * 1/1995 Schmid ..... E04B 1/6813 52/576
8,317,200 B2 * 11/2012 Deiss ..... E06B 1/62 428/40.1
9,200,437 B1 12/2015 Hensley et al.
9,637,915 B1 5/2017 Hensley et al.
9,963,872 B2 5/2018 Hensley et al.
10,066,387 B2 9/2018 Hensley et al.
10,072,413 B2 9/2018 Hensley et al.
10,179,993 B2 1/2019 Hensley et al.
10,184,243 B2 * 1/2019 Hamilton ..... E01C 11/126
10,316,661 B2 6/2019 Hensley et al.
10,422,127 B2 9/2019 Hensley et al.
10,544,582 B2 1/2020 Hensley et al.
10,570,611 B2 2/2020 Hensley et al.
10,794,056 B2 10/2020 Hensley et al.
11,118,346 B2 * 9/2021 Klein ..... E04B 1/942
11,149,432 B2 * 10/2021 Gatland ..... E04B 1/942
2011/0296782 A1 * 12/2011 Wedi ..... E04B 1/6815 52/515

(Continued)

FOREIGN PATENT DOCUMENTS

EP 0244495 A1 * 11/1987 ..... E01D 19/06
EP 3375597 A2 * 9/2018 ..... B26D 3/085

*Primary Examiner* — Brian D Mattei
*Assistant Examiner* — Joseph J. Sadlon
(74) *Attorney, Agent, or Firm* — Crain, Caton & James, P.C.; James E. Hudson, III

(57) ABSTRACT

A foam-based expansion joint seal for use in angular expansion joint segments includes a unitary elongated body having a living hinge, a hinge enclosure for containment of increased adhesive and to reduce stress concentrations, and adhesively-joined surfaces.

20 Claims, 4 Drawing Sheets

(56) References Cited

U.S. PATENT DOCUMENTS

| | | | | |
|---|---|---|---|---|
| 2013/0187348 | A1* | 7/2013 | Deiss | E04B 1/6812 493/356 |
| 2018/0300490 | A1* | 10/2018 | Robinson | E01C 23/028 |
| 2021/0123193 | A1* | 4/2021 | Trivedi | E04B 1/6812 |

* cited by examiner

FOAM-BASED SEAL FOR ANGULAR EXPANSION JOINT SEGMENTS

CROSS-REFERENCE TO RELATED APPLICATIONS

None.

STATEMENT REGARDING FEDERALLY SPONSORED RESEARCH OR DEVELOPMENT

Not Applicable.

BACKGROUND

Field

The present disclosure relates generally systems to foam-based expansion joint seals for use in angular expansion joint segments. More particularly, the present disclosure is directed to providing a foam-based expansion joint seal composed of a unitary elongated body which incorporates a living hinge, a hinge enclosure for containment of increased adhesive and to reduce stress concentrations, and adhesively joined surfaces.

Description of the Related Art

Building construction requires provision accommodating material responses to temperature fluctuations while providing a water-tight exterior. Construction panels come in many different sizes and shapes and may be used for various purposes, including roadways, sideways, tunnels and other pre-cast structures. To provide a seal against environmental contaminants, expansion joint seals have been developed.

Among expansion joint seals are foam-based seals which include a foam body with adhesive on one or more side faces and a water-resistant coating on the exposed face. These foam-based expansion joint seals are compressed on site, or may be provided in a compressed form, are worked into the expansion joint to so the top of the expansion joint seal is at or below the top of adjacent substrates, and are permitted to expand to adhere to the exposed sides of adjacent substrates. These foam-based expansion joint seals are generally provided in common lengths and cut or spliced on site to fit the length of the applicable expansion joint. These foam-based expansion joint seals can be fitted to straight expansion joints and to those expansion joints with gentle changes in direction. To maintain position, these foam-based expansion joint seals are compressed within the joint seal, often at one-half to one-fifth its original width. Because densities of the foam, prior to compression for use in the joint and/or for delivery to the job site, may range from 10 to 200 $kg/m^3$, resulting in an installed density ranging from 20 to 1000 $kg/m^3$.

To accommodate the immediate change in direction occasioned by a corner, it has long been known to create a transition in the field. These have generally been characterized as cross transitions, corner transitions, outside corner transition and inside corner transitions. These field-assembled transitions are generally created by abutting a face of a first foam-based expansion joint seal with a face of a second foam-based expansion joint seal. Cross transitions and corner transitions have been constructed by abutting an end face of the first foam-based expansion joint seal against the side face of the second foam-based expansion joint seal and adhering the two faces together. Other corner transitions have been created by mitering the ends of two foam-based expansion joint seals to provide equally-angled elongated end faces and adhering the two exposed faces to one another so each face aligns with the interior and exterior vertices of the corner. Inside corner transitions have been created by removing a triangular section from the face of a first foam-based expansion joint seal between the interior face of a first side of the corner which aligns with the interior face of the second side of the corner and providing an equal shape at the end of the second foam-based expansion joint seal. The construction of a transition in the field consumes time and may frustrate scheduling issues in the event the construction is less-than-perfect. These efforts may be complicated when a succession of transitions are positioned in rapid succession, such as stair treads, auditorium, and stadiums. Because these transitions feature one face adhered to another, the seam is a point of failure when the surfaces forming the expansion joint corner expand or contract differently and introduce shear forces at the joint face. The forces acting on the joint seal are increased when the joint seal must also provide support in a vertical orientation, such as wall-to-ceiling. These forces may be reduced with the joint seal is provided in a horizontal orientation, such as floor-to-floor, where the joint seal is not required to support a downward-hanging leg. These shear forces in a mitered joint are a well-known cause of failure, particularly as the substrates which bound a corner may move unequally, causing the two legs to fight against one another during unequal movement. This problem of unequal forces may be exacerbated when the foam includes any additives which are unequally distributed. In all such situations, any failure of adhesive between the two faces propagates through the joint, weakening the joint and ultimately resulting in complete failure.

Factory-created foam-based expansion joint seal transitions have created in response to the effort needed for field assembly. These have included corner transitions intended for horizontal-to-vertical transitions where end of the vertically-oriented section may include an angled and flared end to direct liquids and solids away from the expansion joint system. These flared ends, however, may be undesirable and not parallel the adjacent substrates. Other vertical-to-horizontal corner transitions have included a first piece of foam cut and bent to open that cut to a 90° angle, an insert piece of foam provided in the opening, and an elastomer spanning the surfaces of the first piece of foam and the insert piece to maintain the insert in position. These however, introduce a completely additional body which must be maintained in position by elastomer. Corner transitions have also been formed by providing the two legs at a desired relationship by one or more of stamping, cutting, molding and die-cutting. While such construction provides uniform rates of expansion in all directions and at the corner itself, construction of these can be time consuming or wasteful as special forms are needed for molding and because stamping, cutting or die cutting results in foam pieces of undesirably short lengths which may be unusable waste.

It would therefore be beneficial to provide a corner transition which does not suffer from these impediments.

SUMMARY

The present disclosure therefore meets the above needs and overcomes one or more deficiencies in the prior art.

The present disclosure provides an expansion joint seal adapted to fit about a corner of at least 1 degree and not more than 179 degrees which includes a unitary elongated body of compressible foam and an adhesive where the elongated body has a body first section, a body living hinge section, and a body second section, the body first section having a body first section first side and a body first section second side, the body second section having a body second section first side and a body second section second side, the body living hinge section having a body living hinge exterior side from the body first section second side to the body second section second side, the body having a body width from the body first section first side to the body first section second side at the body first section, the body living hinge section intermediate the body first section and the body second section, the body living hinge section having a body living hinge, the body living hinge having a hinge base, a hinge first surface, and a hinge second surface, the hinge base having a hinge base width, the hinge first surface having a first surface profile, the hinge second surface having a second surface profile complementary to the first surface profile, the body living hinge having a hinge centerline bisecting the hinge base and perpendicular to the hinge base, the hinge base distant the body living hinge exterior side along the hinge centerline not more than ten percent of the body width, the hinge first surface and the hinge second surface extending symmetrically to the hinge centerline from the hinge base, the hinge first surface extending from the hinge base to the body first section first side of the body first section, and the hinge second surface extending from the hinge base to the body second section body first side, where the adhesive is adhered to the hinge base and to the hinge first surface adjacent the hinge base.

Additional aspects, advantages, and embodiments of the disclosure will become apparent to those skilled in the art from the following description of the various embodiments and related drawings.

BRIEF DESCRIPTION OF THE DRAWINGS

So that the manner in which the described features, advantages, and objects of the disclosure, as well as others which will become apparent, are attained and can be understood in detail; more particular description of the disclosure briefly summarized above may be had by referring to the embodiments thereof that are illustrated in the drawings, which drawings form a part of this specification. It is to be noted, however, that the appended drawings illustrate only typical preferred embodiments of the disclosure and are therefore not to be considered limiting of its scope as the disclosure may admit to other equally effective embodiments.

In the drawings.

DETAILED DESCRIPTION

The present disclosure provides a corner transition for use inangular expansion joint segments using a unitary elongated body which incorporates a living hinge, a hinge enclosure for containment of increased adhesive and to reduce stress concentrations, and adhesively-joined surfaces and therefore avoids the delamination occurring from shearing forces, the need for an elastomer to maintain transition components in relation to one another and which includes functions without providing uniform expansion forces throughout, while reducing waste and avoiding performance failures caused by unequally distributed additives and the resulting unequal densities of the modified foam.

Figure 1:
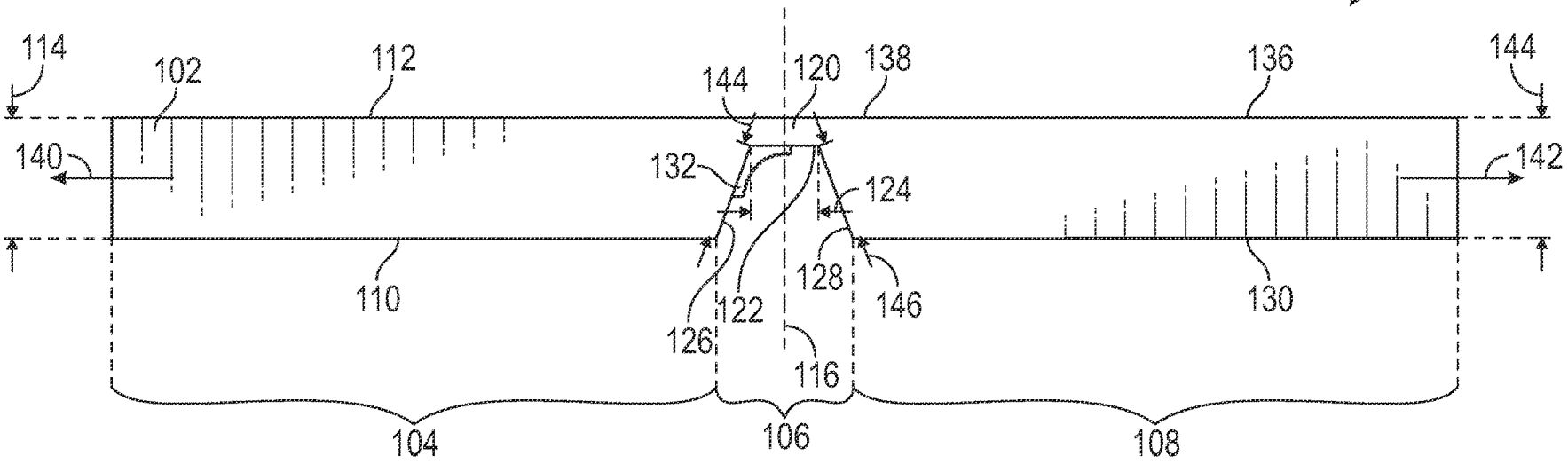
FIG. 1 provides a top view of an expansion joint seal prior to engagement of the body living hinge according to the present disclosure.

Referring to FIG. 1, a top view of an expansion joint seal prior to engagement of the body living hinge according to the present disclosure is provided. The expansion joint seal 100 is adapted to fit about a corner having an angle between 1 and 179 degrees and includes a unitary elongated body 102 and an adhesive 132. The elongated body 102 has a body first section 104, a body living hinge section 106, and a body second section 108. The first body section 104, the body living hinge section 106, and the body second section 108 may be constructed of a continuous, non-spliced, homogenous composition of compressible foam.

The body first section 104 may have a body first longitudinal axis 140 and the body second section 108 may have a body second longitudinal axis 142.

The unitary elongated body 102 is a single piece of a compressible foam. Preferably, the unitary elongated body 102 is composed of an open-celled foam, which may be a polyurethane. The unitary elongated body 102, while of a homogeneous composition of compressible foam, may include fillers, fire retardants, water retardants, insect-repelling material, and other additives, introduced by methods known in the art such as impregnation and infusion. The additive may be introduced to different extents along the unitary elongated body 102, altering the localized properties of portions of the expansion joint seal 100. The body living hinge section 106 may include a lower density of additive, which may result in a greater flexibility and higher expansion rate than the same for the body first section 104 and the body second section 108. After installation, the unitary elongated body 102 of compressible foam is compressed one-fifth to one-half of the body width 114, so the unitary elongated body 102 is a single piece of a compressible foam must be compressible to at least one-fifth of the body width 114.

The unitary elongated body 102 may have a first rate of expansion in the body first section 104 from the body first section first side 110 and the body first section second side 112, the first rate of expansion in the body second section 108 from the body second section first side 130 and a body second section second side 136, and a second rate of expansion in the body living hinge 120 from the hinge base 122 to the body living hinge exterior side 138, the first rate of expansion and the second rate of expansion being unequal, the expansion joint seal not having a uniform rate of expansion and contraction. The second rate of expansion may be less than the first rate of expansion.

The body first section 104 has a body first section first side 110 and a body first section second side 112. The body 102 has a body width 114 from the body first section first side 110 to the body first section second side 112 at the body first section 104.

The body second section 108 has a body second section first side 130 and a body second section second side 136. The body second section 108 has a body second section width 144 from the body second section first side 130 to the body second section second side 136. The body second section width 144 may be equal to or less than the body width 114 to accommodate the two expansion joints meeting at a corner.

Figure 5:
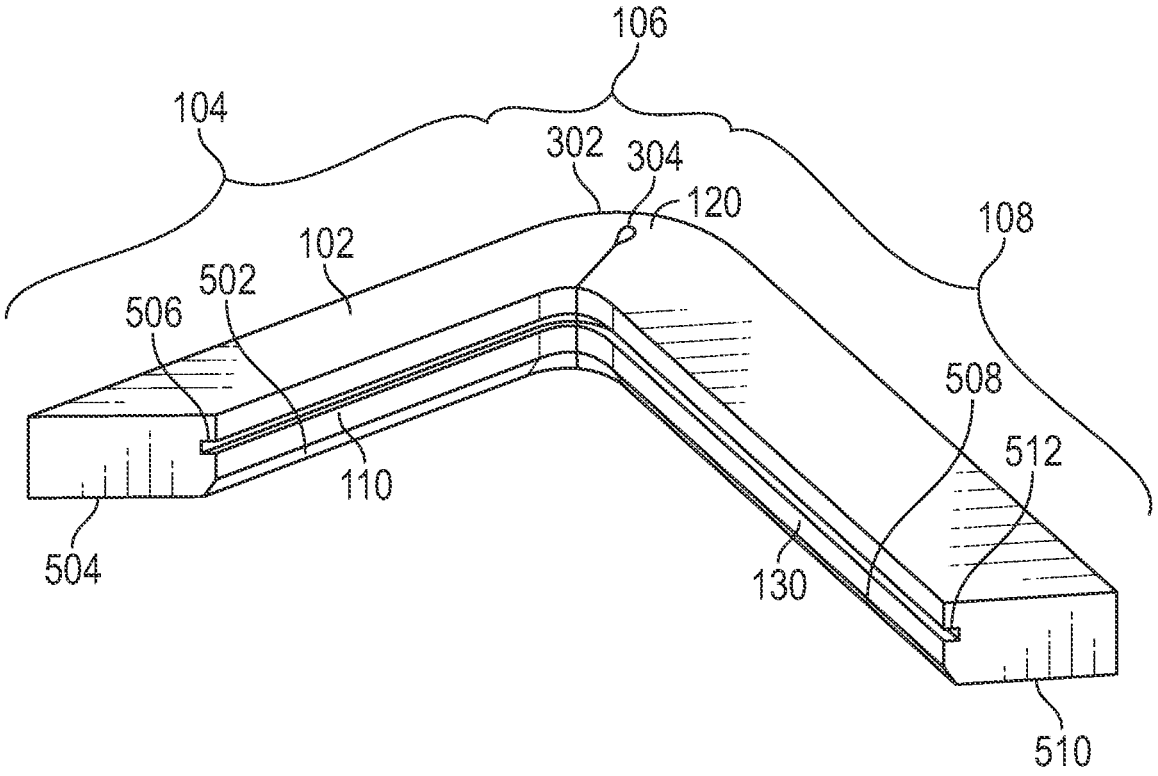
FIG. 5 provides an isometric view of the expansion joint seal after engagement of the body living hinge according to the present disclosure.

Referring to FIG. 5, an isometric view of the expansion joint seal 100 of the present disclosure is provided. The body first section 104 may be a first rectangular prism, but may include modifications for ease of use, such as chamfered surface 502 adjacent its body first section bottom 504 and side channels 506 in one or both of the body first section first side 110 and the body first section second side 112.

The body second section 108 may be a second rectangular prism, which may be sized equal to the first rectangular prism, but may include modifications for ease of use, such as chamfered surface 508 adjacent its body second section bottom 510 and side channels 512 in one or both of the body second section first side 130 and the body second section second side 136.

Referring again to FIG. 1, the body living hinge section 106 has a body living hinge exterior side 138 from the body first section second side 112 to the body second section second side 136. The body living hinge section 106 is intermediate the body first section 104 and the body second section 108. Within the body living hinge section 106 is a body living hinge 120. Living hinges are used in other industries to provide a thin flexible hinge or flexure bearing from the same material as the two rigid pieces it connects. The body living hinge 120 has a hinge base 122, a hinge first surface 126, and a hinge second surface 128. The hinge base 122 has a hinge base width 124 and may be a profile which may be flat or curved and has a hinge base width 124. In use, the unitary elongated body 102 is bent at the body living hinge 120.

Figure 3:
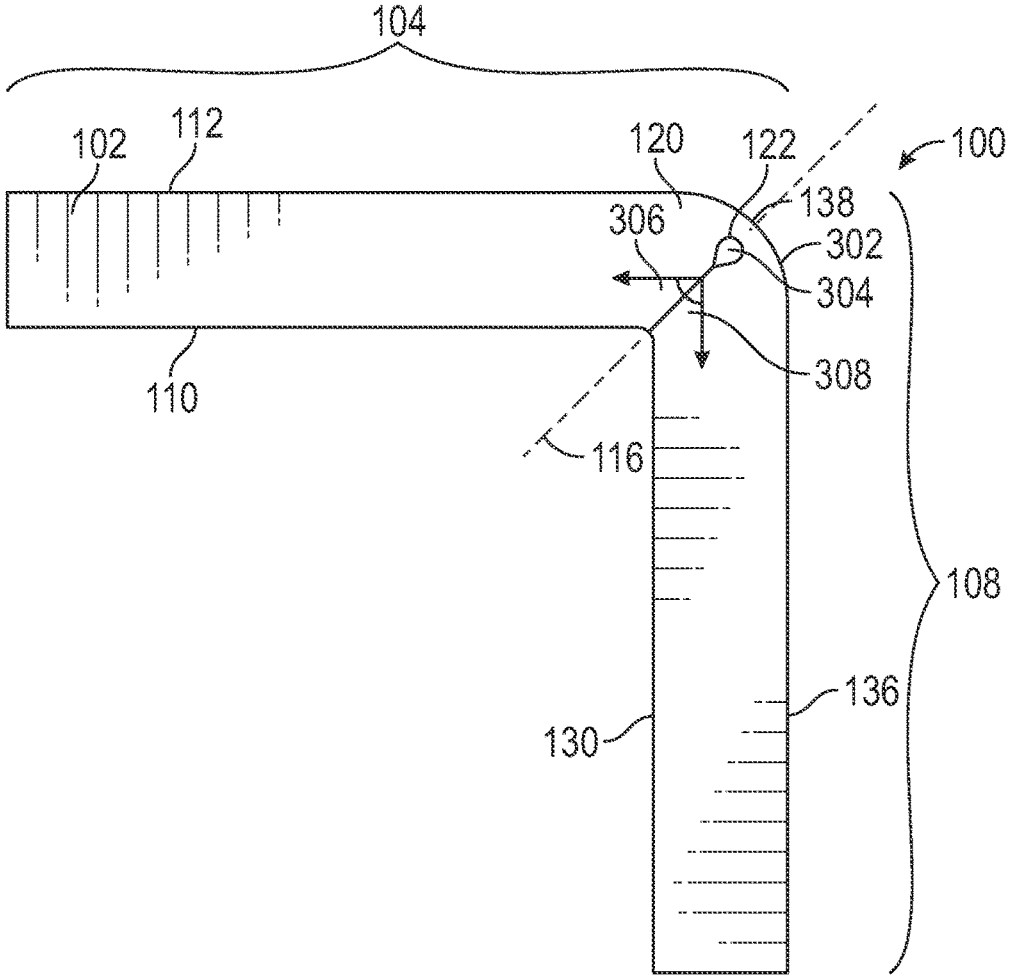
FIG. 3 provides a top view of an expansion joint seal after engagement of the body living hinge according to the present disclosure.

Referring to FIG. 3, a top view of an expansion joint seal 100 after engagement of the body living hinge 120 according to the present disclosure is provided. Because the hinge base 122 has a width 124, when the body living hinge 120 is articulated about the hinge centerline 116 to provide the bend in the expansion joint seal 100, a hinge enclosure 304 is provided when the hinge first surface 126 contacts the hinge second surface 128. The hinge enclosure 304 is generally teardrop shaped, eliminating providing a solid surface at the termination of the resulting partial-miter joint created by the hinge first surface 126 contacts the hinge second surface 128 and thereby providing an internal stop against any failure propagation of the associated joint due to shear forces. The hinge enclosure 304 therefore avoids the stress concentration of the seam. The hinge enclosure 304 may be entirely filled with the adhesive 132. The adhesive 132 in the hinge enclosure 304 provides a further stop on stress concentration as the force is distributed, reducing the potential for shear movement of one of the hinge first surface 126 and the second surface 128 against the other, and failure of the expansion joint seal 100 by one surface separating from the other and allowing contaminants into the expansion joint. The hinge enclosure 304 of the expansion joint seal 100, particularly when filled with adhesive, thereby avoids the failure of a conventional miter joint.

Figure 4:
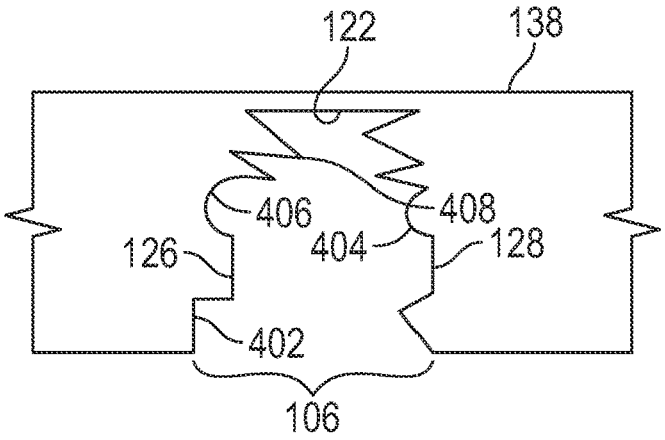
FIG. 4 provides a view of a body living hinge section with alternative hinge first surface profiles.

Referring again to FIG. 1, because the hinge first surface 126 will contact the hinge second surface 128, the hinge first surface 126 has a first surface profile and the hinge second surface 128 has a second surface profile complementary to the first surface profile. The hinge first surface 126 may a hinge first surface profile to facilitate load transfer, such as flat, such as illustrated in FIG. 1. Referring to FIG. 4, a view of a body living hinge section 106 with alternative hinge first surface profiles is provided, which may include concave 406, convex 404, saw tooth 408, and steps 402. The hinge second surface 128 has a hinge second surface profile selected to be complementary to the first surface profile consisting of a flat, such as illustrated in FIG. 1, concave 406, convex 404, saw tooth 408, and steps 402, as illustrated in FIG. 4. Prior to being bent for use, the hinge base 122, the hinge first surface 126, and the hinge second surface 128 define an opening 134 opposite the body living hinge exterior side 138. Once the expansion joint seal 100 is bent for use, the opening 134 is closed. With the hinge first surface 126 and the hinge second surface 128 having complementary non-flat surface profiles provides additional load-transfer surfaces to reduce shear forces acting on the surfaces and the associated failure.

The body living hinge 120 has a hinge centerline 116 which bisects the hinge base 122 and is perpendicular to the hinge base 122. The hinge base 122 is distant the body living hinge exterior side 138 along the hinge centerline 116 not more than ten percent of the body width 114. The resulting body living hinge 120 is sufficiently thin to permit the bending into position and sufficiently thick to provide the hinge base 122 which, together with an adhesive 132, avoids the shearing failure of the miter joints known in the prior art. The hinge first surface 126 and the hinge second surface 128 extend symmetrically to the hinge centerline 116 from the hinge base 122. The hinge first surface 126 extends from the hinge base 122 to the body first section first side 110 of the body first section 104 while the hinge second surface 128 extending from the hinge base 122 to the body second section body first side 130.

Where the expansion joint seal 100 is used for a corner of two expansion joints having equal widths, the hinge centerline 116 will be perpendicular to the body living hinge exterior side 138 and the body first longitudinal axis 140 prior to the expansion joint seal 100 being bent for use. In such a case, after bending, the hinge centerline 116 will be at equal angles to each of the body first longitudinal axis 140 and the body second longitudinal axis 142. Likewise, in such circumstance, the hinge first surface 126 has a hinge first surface length 144 equal to the hinge second surface length 146 of the hinge second surface 128.

Figure 2:
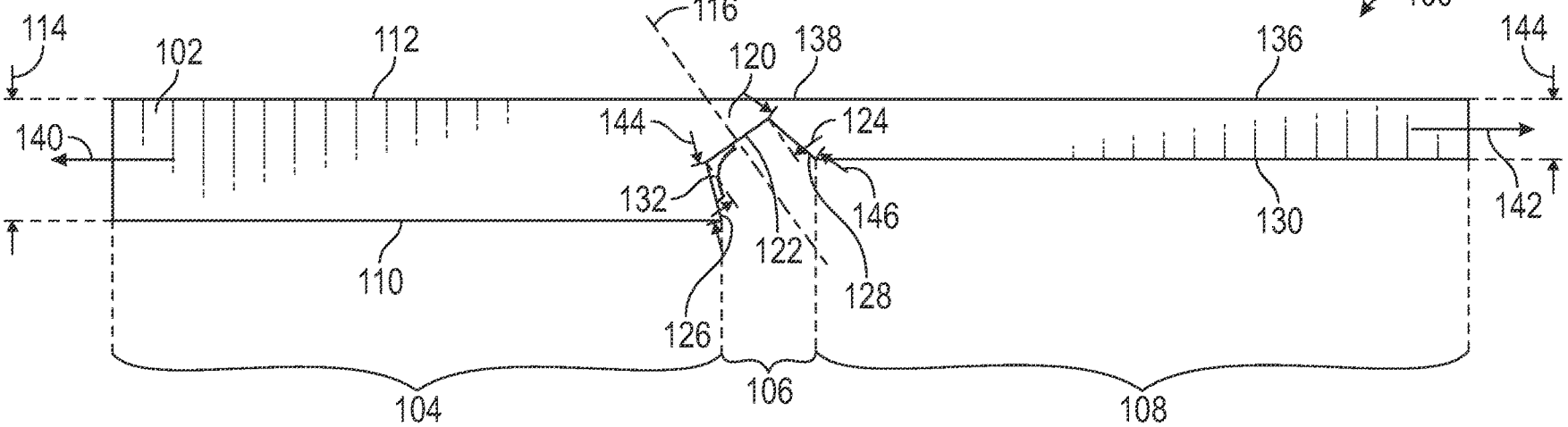
FIG. 2 provides a top view of an expansion joint seal prior to engagement of the body living hinge according to the present disclosure where the body second section width is than the body width prior to engagement of the body living hinge according to the present disclosure.

Referring to FIG. 2, a top view of an expansion joint seal prior to engagement of the body living hinge according to the present disclosure where the body second section width 144 is than the body width 114 is provided. Where the expansion joint seal 100 is used for a corner of expansion joints having unequal widths, the hinge centerline 116 may not be perpendicular to the body living hinge exterior side 138 prior to the expansion joint seal 100 being bent for use. A non-perpendicular hinge centerline 116 permits the resulting hinge first surface length 144 and to the hinge second surface length 146 to be equal, fitting to the corner without gap.

Referring to FIG. 3, once bent, the body first longitudinal axis 140 may extend away from the hinge base 122 at a first angle 306 to the hinge centerline 116 and the body second longitudinal axis 142 may extend away from the hinge base 122 at the hinge base 122 at a second angle 308 to the hinge centerline 116 opposite the first angle 306, where the first angle 306 is equal to the second angle 308.

As a result of the body living hinge exterior side 138 being put into tension, the expansion rate of the body 102 is reduced through the body living hinge section, resulting in non-uniform expansion of the expansion joint seal 100 and a non-uniform force applied by the expansion joint seal 100 to the substrates after installation. Because the hinge base 122 provides a continuous surface in opposition to the hinge first surface 126 and the hinge second surface 128, a stress concentration is avoided and shear movement eliminated, prolonging the life and functionality of the expansion joint seal 100.

An adhesive 132 is provided on the hinge base 122 and to the hinge first surface 126 adjacent the hinge base 122. The adhesive 132 may also be provided on the hinge second surface 128. The adhesive 132 may be provided in such quantities that some portion may be expelled from the expansion joint seal 100 after being bent into position to ensure a sufficient amount within the expansion joint seal 100 and to provide a further seal external the expansion joint seal 100 where a portion of the adhesive 132 is expelled. The adhesive 132 may be selected from known compounds, including glues, elastomers, cyanoacrylates, and chemical bonding agent, which cause the two surfaces to adhere together or creates a chemical bond. The hinge first surface 126, the body living hinge section 106, the hinge second surface 128, and the adhesive 132 form a chemical and mechanical bond. To increase the bonds and further reduce the potential for shear failure, the adhesive 132 may be penetrated into the body of compressible foam 102 at the hinge base 122 and the hinge first surface 126. The resulting accumulation of adhesive atop the hinge base 122 provides resistance to the stress applied to the joint of the hinge first surface 126 to the hinge second surface 128.

The first body section 104, the body living hinge section, and the body second section be constructed of a continuous, non-spliced, homogenous composition of compressible foam so that the expansion joint seal 100 provides a non-continuous transition around a corner as a result of the connection formed by the body first section 104, the body living hinge section 106, and the body second section 108 being adhered together at the hinge first surface 126 and the hinge second surface 128.

Figure 6:
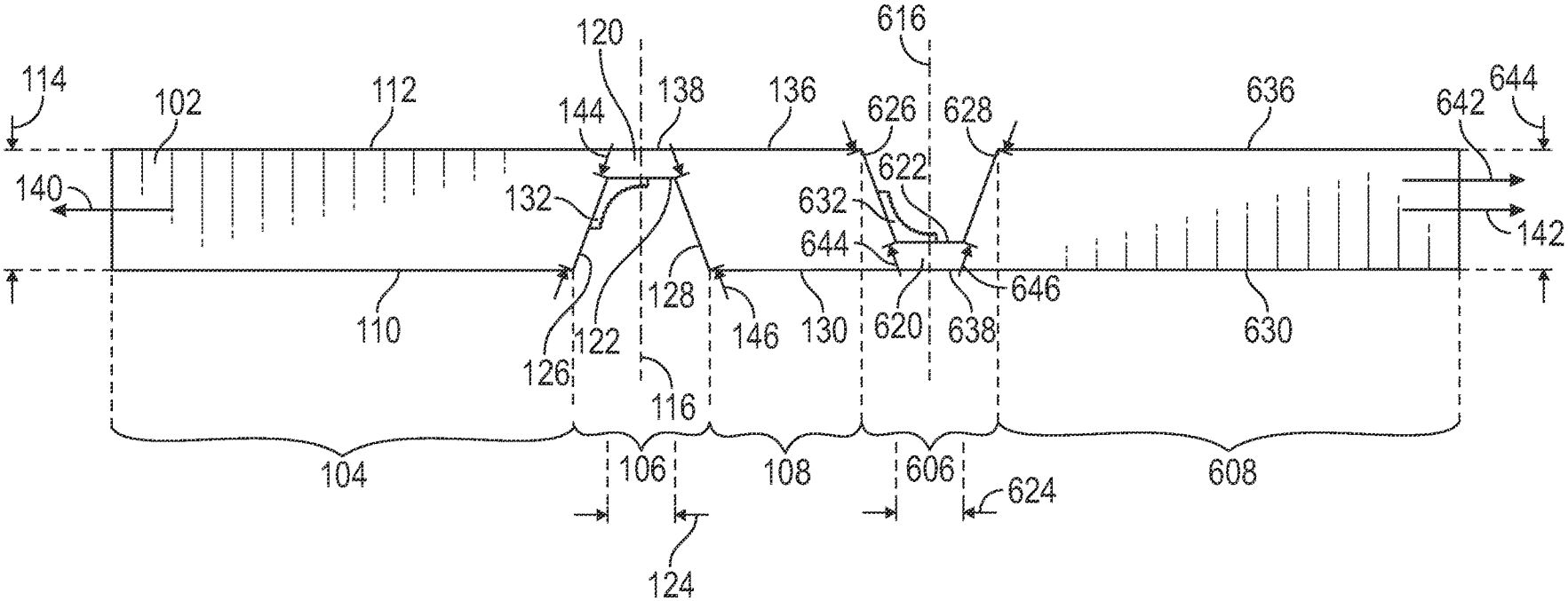
FIG. 6 provides a top view of an expansion joint seal with a second living hinge prior to engagement of the body living hinge and the second living hinge according to the present disclosure.

Referring to FIG. 6, a top view of an expansion joint seal 100 with a second living hinge 622 prior to engagement of the body living hinge 122 and the second living hinge 622 according to the present disclosure is provided. The expansion joint seal 100 may include a plurality of living hinges to provide multiple changes in direction and thereby avoid the need for multiple field splices in a material which is compressed. A second living hinge 622 may be provided on either side of the unitary elongated body 102 is a single piece of a compressible foam. Further living hinges may be positioned on either side. As provided in FIG. 6, the expansion joint seal 100 then includes a body third section 608, a body second living hinge section 606, a body second living hinge 620, and a second adhesive 632. The body third section 608 has a body third section first side 630 and a body third section second side 636. The body second living hinge section 606 is intermediate the body second section 108 and the body third section 608 and has a body second living hinge exterior side 638 from the body second section first side 130 to the body third section first side 630. The body second living hinge 620 has a second hinge base 622, a second hinge first surface 626, and a second hinge second surface 628. The second hinge first surface 626 has a second hinge first surface profile and the second hinge second surface 628 has a second hinge second surface profile complementary to the second hinge first surface profile. The body second living hinge 620 has a second hinge centerline 616 bisects the second hinge base 622 and perpendicular to the second hinge base 622. The second hinge base 622 has a second hinge base width 624 and is distant the body second living hinge exterior side 638 along the second hinge centerline 616 not more than ten percent of the body width 114. The second hinge first surface 626 and the second hinge second surface 628 extends symmetrically to the second hinge centerline 616 from the second hinge base 622. The second hinge first surface 626 extends from the second hinge base 622 to the body second section second side 136, and the second hinge second surface 628 extends from the second hinge base 622 to the body third section second side 636. The second adhesive 632 is adhered to the second hinge base 622 and to the second hinge first surface 626 adjacent the second hinge base 622. The first body section 104, the body living hinge section 106, the body second section 108, the body second living hinge section 606, and the body third section 608 may be constructed of a continuous, non-spliced, homogenous composition of compressible foam. The second adhesive 632 may be provided to penetrate into the body of compressible foam 102 at the second hinge base 622 and the second hinge first surface 626. The second hinge base 622 may provide a second hinge enclosure similar to the hinge enclosure 304 when the second hinge first surface 626 contacts the second hinge second surface 628 when the second body living hinge 120 is articulated about the second hinge centerline 616. The second hinge first surface 626, the body second living hinge section 606, the second hinge second surface 628, and the second adhesive 632 form a chemical and mechanical bond. For use, the unitary elongated body is bent at the body second living hinge 620 so the second hinge enclosure is entirely filled with the second adhesive and each of the body first section 104, the body second section 108, and the body third section 608 is a rectangular prism.

The foregoing disclosure and description is illustrative and explanatory thereof. Various changes in the details of the illustrated construction may be made within the scope of the appended claims without departing from the spirit of the invention. The present invention should only be limited by the following claims and their legal equivalents.

We claim:

1. An expansion joint seal adapted to fit about a corner of at least 1 degree and not more than 179 degrees, comprising:

a unitary elongated body of compressible foam, the elongated body having a body first section, a body living hinge section, and a body second section, the body first section having a body first section first side and a body first section second side, the body second section having a body second section first side and a body second section second side, the body living hinge section having a body living hinge exterior side from the body first section second side to the body second section second side, the body having a body width from the body first section first side to the body first section second side at the body first section;

the body living hinge section intermediate the body first section and the body second section;

the body living hinge section having a body living hinge, the body living hinge having a hinge base surface, a hinge first surface, and a hinge second surface, the hinge base surface having a hinge base width, the hinge first surface having a first surface profile, the hinge second surface having a second surface profile complementary to the first surface profile, the body living hinge having a hinge centerline bisecting the hinge base surface and perpendicular to the hinge base surface, the hinge base surface distant the body living hinge exterior side along the hinge centerline not more than ten percent of the body width, the hinge first surface and the hinge second surface extending symmetrically to the hinge centerline from the hinge base surface, the hinge first surface extending from the hinge base surface to the body first section first side of the body first section, and the hinge second surface extending from the hinge base surface to the body second section body first side; and an adhesive adhered to the hinge base and to the hinge first surface adjacent the hinge base.

2. The expansion joint seal of claim 1, wherein the body first section, the body living hinge section, and the body second section are constructed from a continuous, non-spliced, homogenous composition of compressible foam.

3. The expansion joint seal of claim 2, wherein the adhesive penetrates into the body of compressible foam at the hinge base surface and the hinge first surface.

4. The expansion joint seal of claim 3, wherein the hinge base surface provides a hinge enclosure when the hinge first surface contacts the hinge second surface when the body living hinge is articulated about the hinge centerline.

5. The expansion joint seal of claim 4, wherein the hinge first surface, the body living hinge section, the hinge second surface, and the adhesive form a chemical and mechanical bond.

6. The expansion joint seal of claim 5, wherein the unitary elongated body is bent at the body living hinge.

7. The expansion joint seal of claim 6, wherein the hinge enclosure is entirely filled with the adhesive.

8. The expansion joint seal of claim 7, wherein the body first section is a rectangular prism and the body second section is a second rectangular prism.

9. The expansion joint seal of claim 8, wherein the unitary elongated body having a first rate of expansion in the body first section from the body first section first side and the body first section second side;

the unitary elongated body has the first rate of expansion in the body second section from the body second section first side and a body second section second side;

and a second rate of expansion in the body living hinge from the hinge base surface to the body living hinge exterior side, the first rate of expansion and the second rate of expansion being unequal, the expansion joint seal not having a uniform rate of expansion and contraction.

10. The expansion joint seal of claim 9, wherein the second rate of expansion is less than the first rate of expansion.

11. The expansion joint seal of claim 8, further comprising:

the body first section having a body first longitudinal axis, the body second section having a body second longitudinal axis, the body first longitudinal axis extending away from the hinge base surface at the hinge centerline at a first angle to the hinge centerline, the body second longitudinal axis extending away from the hinge base surface at the hinge centerline at a second angle to the hinge centerline opposite the first angle; and the first angle equal to a second angle.

12. The expansion joint seal of claim 8, wherein the hinge base surface has a profile selected from the group of shapes consisting of a flat line and a curved line.

13. The expansion joint seal of claim 8, wherein the hinge first surface has a hinge first surface profile selected from the group consisting of flat, concave, convex, saw tooth, and steps and the hinge second surface has a hinge second surface profile selected to be complementary to the first surface profile selected from the group consisting of flat, convex, concave, saw tooth, and steps.

14. The expansion joint seal of claim 13, wherein the hinge centerline is not perpendicular to the body first section second side.

15. The expansion joint seal of claim 13, wherein the hinge centerline is perpendicular to the body first section second side.

16. The expansion joint seal of claim 13 wherein the body first section of the body of compressible foam includes an additive, the additive as a first density, the body living hinge section including the additive at a second density, the second density less than the first density, the body living hinge section having a greater flexibility than the body first section, and the body living hinge section having a higher expansion rate than the body first section.

17. The expansion joint seal of claim 8 wherein the unitary elongated body of compressible foam is compressed to one-fifth to one-half of the body width.

18. The expansion joint seal of claim 8 further comprising:

a body third section having a body third section first side and a body third section second side, a body second living hinge section having a body second living hinge exterior side from the body second section first side to the body third section first side, the body second living hinge section intermediate the body second section and the body third section;

a body second living hinge having a second hinge base surface, a second hinge first surface, and a second hinge second surface, the second hinge base surface having a second hinge base width, the second hinge first surface having a second hinge first surface profile, the second hinge second surface having a second hinge second surface profile complementary to the second hinge first surface profile, the body second living hinge having a second hinge centerline bisecting the second hinge base surface and perpendicular to the second hinge base surface, the second hinge base surface distant the body second living hinge exterior side along the second hinge centerline not more than ten percent of the body width, the second hinge first surface and the second hinge second surface extending symmetrically to the second hinge centerline from the second hinge base surface, the second hinge first surface extending from the second hinge base surface to the body second section second side, and the second hinge second surface extending from the second hinge base surface to the body third section second side; and a second adhesive adhered to the second hinge base surface and to the second hinge first surface adjacent the second hinge base surface.

19. The expansion joint seal of claim 18, further comprising:

the body second section, the body third section, and the body second living hinge section constructed from a continuous, non-spliced, homogenous composition of compressible foam;

the second adhesive penetrating into the body of compressible foam at the second hinge base surface and the second hinge first surface;

the second hinge base surface providing a second hinge enclosure when the second hinge first surface contacts the second hinge second surface when the body second living hinge is articulated about the second hinge centerline;

the second hinge first surface, the body second living hinge section, the second hinge second surface, and the second adhesive form a chemical and mechanical bond;

the unitary elongated body bent at the body second living hinge;

the second hinge enclosure entirely filled with the second adhesive; and the body third section is a third rectangular prism.

20. The expansion joint seal of claim 8 wherein the body first section is a rectangular prism having at least one surface selected from the group consisting of a chamfered surface adjacent a body first section bottom, a body first section first side channel in the body first section first side and a body first section second side channel the body first section second side.

* * * * *